US008888323B2

(12) United States Patent
Alfier et al.

(10) Patent No.: US 8,888,323 B2
(45) Date of Patent: Nov. 18, 2014

(54) LIGHTING DEVICE

(71) Applicants: Alberto Alfier, Vedelago (IT); Simon Bobbo, Chirignago (IT); Alessio Griffoni, Fossó (IT); Dina Pasqualini, Udine (IT); Matteo Toscan, Maser (IT); Franco Zanon, Cassola (IT)

(72) Inventors: Alberto Alfier, Vedelago (IT); Simon Bobbo, Chirignago (IT); Alessio Griffoni, Fossó (IT); Dina Pasqualini, Udine (IT); Matteo Toscan, Maser (IT); Franco Zanon, Cassola (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/039,951

(22) Filed: Sep. 27, 2013

(65) Prior Publication Data

US 2014/0085887 A1 Mar. 27, 2014

(30) Foreign Application Priority Data

Sep. 27, 2012 (IT) ..... 2012 A 000836

(51) Int. Cl.

| | |
|---|---|
| ***F21V 1/00*** | (2006.01) |
| ***F21V 11/00*** | (2006.01) |
| ***F21V 7/00*** | (2006.01) |
| ***F21V 15/01*** | (2006.01) |
| ***F21V 17/00*** | (2006.01) |

(52) U.S. Cl.

CPC ..... *F21V 7/0083* (2013.01); *F21V 15/01* (2013.01); *F21V 17/005* (2013.01)

USPC .. 362/241; 362/249.02; 362/240; 362/249.06

(58) Field of Classification Search

CPC .. G02B 6/0073; G02B 19/0066; G02B 6/009; G02B 6/3512; F21Y 2101/02; F21Y 2105/001; F21V 17/12; F21V 5/007; F21V 19/0055; F21V 19/0015; F21V 19/045; F21V 7/0066; F21L 4/027

See application file for complete search history.

(56) References Cited

U.S. PATENT DOCUMENTS 7,914,162 B1 3/2011 Huang

FOREIGN PATENT DOCUMENTS

| | | |
|---|---|---|
| DE | 20 2009 000 236 | 6/2010 |
| DE | 10 2009 056 904 | 6/2011 |
| WO | WO 2010/079089 | 7/2010 |

OTHER PUBLICATIONS

Search Report dated Jan. 1, 2014 issued in the corresponding European Patent Application No. 13 18 2395.7.

*Primary Examiner* — Donald Raleigh
(74) *Attorney, Agent, or Firm* — Cozen O'Connor

(57) ABSTRACT

Lighting device, usable for example with LED light sources, comprises a bowl-shaped body having a base surface with a plurality of mounting studs projecting from the base surface, together with one or more boards for the mounting of light radiation sources, provided with holes for the passage of respective mounting studs. The board has pairs of mounting locations for light radiation sources, each pair being arranged on opposite sides of a respective hole so as to be located on opposite sides of the stud which extends through said respective hole. A plurality of reflectors is provided in order to project the light radiation from the device. The reflectors each have an inlet opening for the light radiation and are capable of being mounted on the mounting studs selectively in one of at least two opposite mounting positions in which the inlet opening is placed at one of said mounting locations.

11 Claims, 6 Drawing Sheets

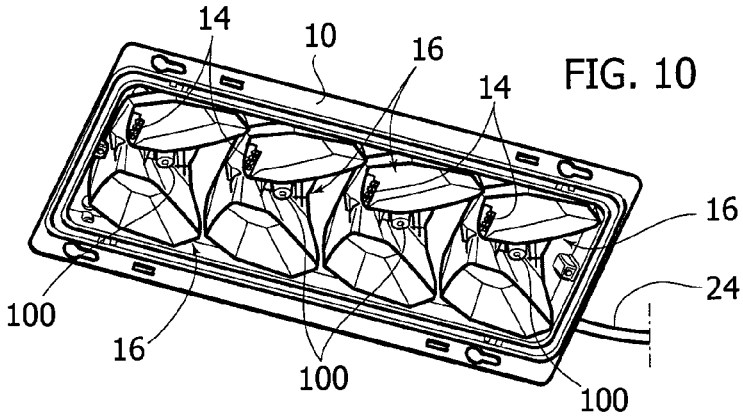
FIG. 10
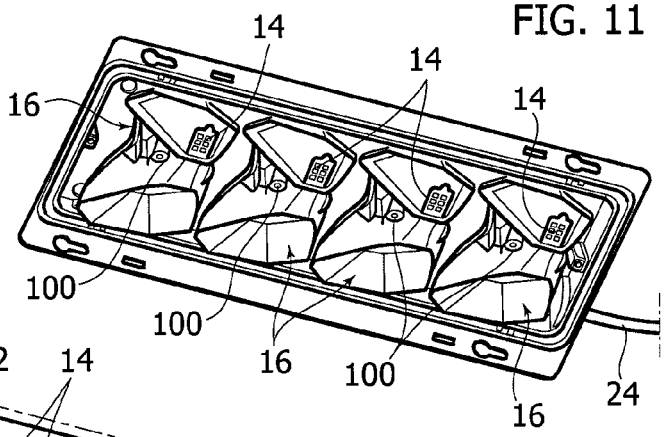
FIG. 11
FIG. 12
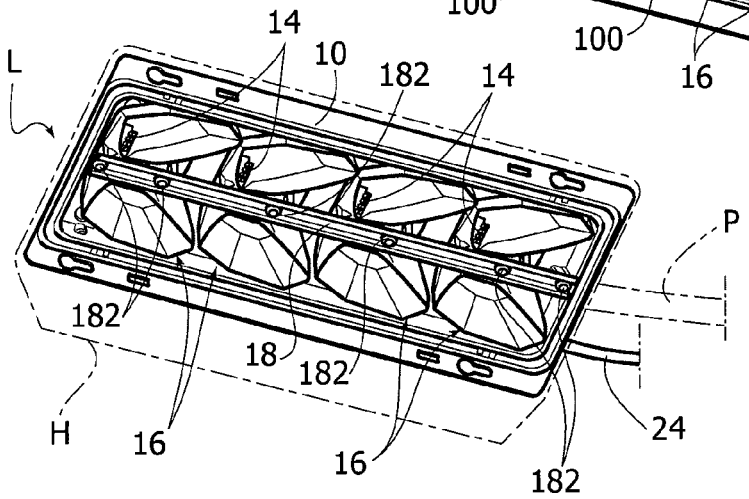
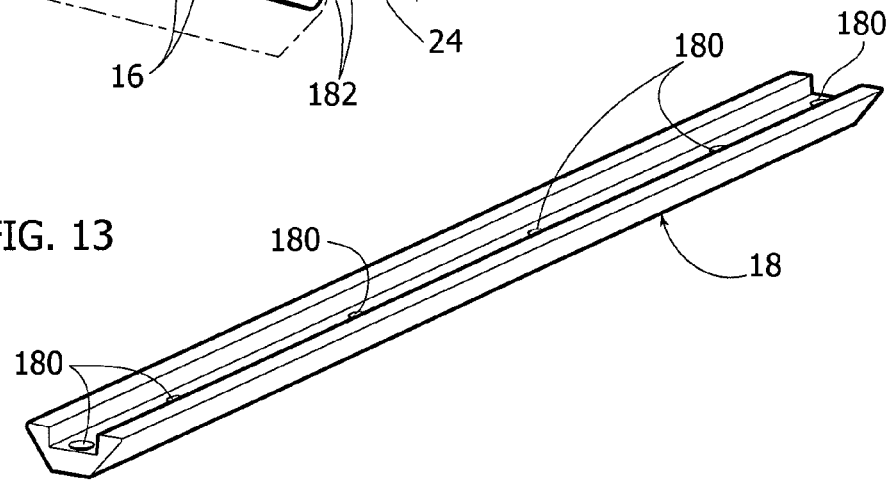
FIG. 13

LIGHTING DEVICE

RELATED APPLICATIONS

This application claims the priority of Italian Application No. TO2012A000836 filed Sep. 27, 2012, the entire content of which is hereby incorporated by reference.

FIELD OF THE INVENTION

The present description relates to lighting devices. Various embodiments may relate to lighting devices using solid state light radiation sources, for example LED sources.

BACKGROUND OF THE INVENTION

Lighting devices, for street lighting for example, with solid state light radiation sources (for example LED sources) are considered to be competitive because of their efficiency and their lighting performance, for example in terms of high luminosity per watt (lm/W) and because of the possibility of increasing the spacing between the standards on which they are mounted.

Devices intended for specific applications (such as ordinary street lighting and the lighting of highways, pedestrian areas, bicycle paths, etc.) may offer special forms of lighting distribution provided by means of standard structures, in such a way that the same basic components (light radiation sources, mounting boards such as printed circuit boards (PCBs), casings, wiring, etc.) can be used with changes in the associated optical systems, as required by the specific applications.

However, solutions of this type may be limited in their flexibility by the generally small number of different combinations that can be obtained with the same basic components.

These considerations are valid not only for solutions based on refractive optics but also for those based on reflective optics.

In the case of refractive optics, a distributed array of light radiation sources (for example, 8 to 16 LEDs spaced a few centimeters apart) may have an associated "family" of lenses, made of plastic material for example, formed in one piece. Each type of lens provides a specific radiation configuration on the road surface, making it possible to provide different applications by using multiple arrays of multiple lenses.

These solutions are inherently limited in terms of the reliability of the lenses, particularly those made of plastic material, which are to be placed in the proximity of the light radiation sources, and also in terms of the high sensitivity to the configuration of the radiation emission from the source (of the LED type for example), and the possibility of causing a greater amount of dazzle than where reflective optics are used.

Reflective optics may, for example, include the use of a certain number of groups (or "clusters") of LEDs on a printed circuit board (PCB) coupled to aluminized reflectors which can be made, for example, in different versions. In all cases it may be possible to include additional components so as to provide, for example, a radiation configuration suited to the lighting of pedestrian areas, on the basis of a version used for street lighting. Various solutions may also allow the lighting configuration to be rotated, through 180° for example, by rotating the module inside the lighting device in a corresponding way.

However, solutions of this type may be subject to limitations due, for example, to the fact that the rotation of the reflector may require a corresponding rotation of the board on which the light radiation source is mounted, or may require the provision of board and radiation source assemblies of a different type. Because of all these factors, there are evident limitations in terms of flexibility of use.

SUMMARY OF THE INVENTION

A lighting device comprising a bowl-shaped body having a base surface with a plurality of mounting studs projecting from the base surface; at least one board for mounting light radiation sources, provided with holes for the passage of respective studs of said plurality, the at least one board having pairs of mounting locations for light radiation sources, each pair being arranged on opposite sides of a respective hole so as to be located on opposite sides of the stud which extends through said respective hole; and a plurality of reflectors for projecting the light radiation from the device, the reflectors having an inlet opening for the light radiation and being capable of being mounted on the aforesaid mounting studs selectively in one of at least two opposite mounting positions in which the inlet opening is placed at one of said mounting locations.

BRIEF DESCRIPTION OF THE DRAWINGS

Various embodiments will now be described, purely by way of non-limiting example, with reference to the appended drawings, of which:

FIGS. 10 to 12 show various possibilities for mounting some embodiments, FIG. 13 shows a component that can be used for mounting some embodiments.

DETAILED DESCRIPTION OF THE DRAWINGS

Figure 1:
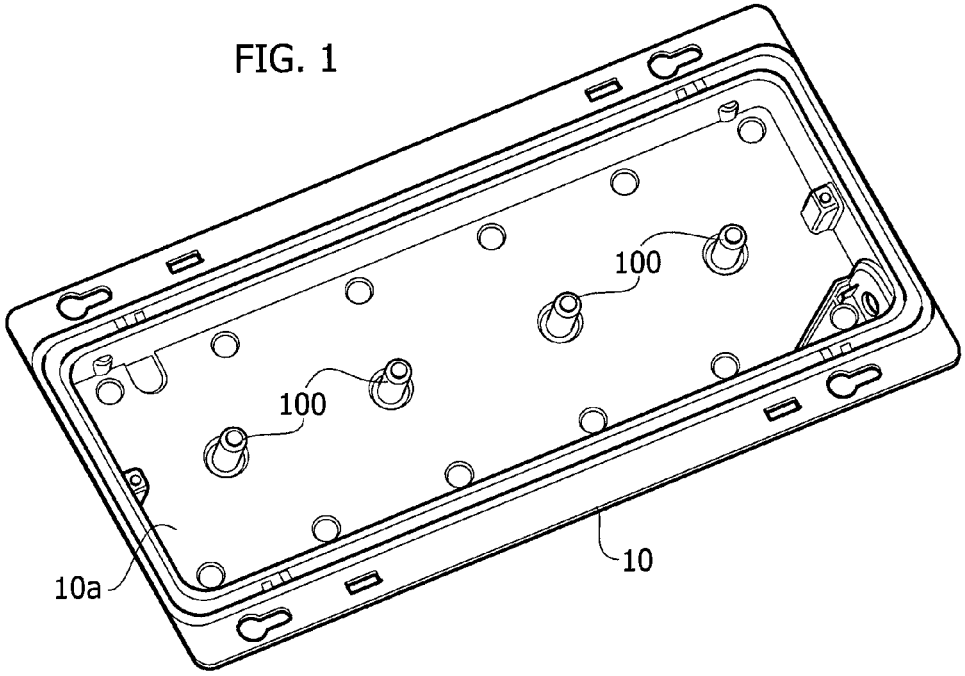
FIG. 1 is a perspective view of a component of some embodiments.

The following description illustrates various specific details intended to provide a deeper understanding of various exemplary embodiments. The embodiments may be produced without one or more of the specific details, or with other methods, components, materials, etc. In other cases, known structures, materials or operations are not shown or described in detail, in order to avoid obscuring various aspects of the embodiments.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in any suitable way in one or more embodiments.

The references used herein are provided purely for convenience and therefore do not define the scope of protection or the extent of the embodiments.

The drawings relate to embodiments of a lighting device L.

In various embodiments, the device may be a street lighting device intended to be mounted, for example, at the top of a standard, suspended from an overhead line, or in other ways.

FIG. 12 shows schematically the possibility of mounting the device L on top of a standard P, for example in a position generally above ground (for example, above a roadway, a pedestrian area, a bicycle path, etc.).

For this purpose (that is to say, for the purpose of mounting and also for the purpose of protection from the external environment), the lighting device L may be provided with a casing H, shown in chained lines in FIG. 12 only. The other figures relate primarily to the internal structure of the device L; in these figures, the casing H is not shown, for the sake of clarity and simplicity of illustration.

In various embodiments (described in greater detail below), the device comprises a base body 10 in which one or more boards 12*a*, 12*b* (made, for example, with printed circuit board (PCB) technology) can be mounted, these boards being capable of being fitted with arrays or clusters of solid state light radiation sources (such as LED sources) 14 (see, in particular, FIGS. 10 to 12).

In order to project the light radiation generated by the sources 14 toward the outside of the device, reflectors 16 are mounted in the body 10 and can be held in position by a retaining bar 18.

In various embodiments, the device may also comprise additional reflectors 20.

In various embodiments, the body 10 may be generally bowl-shaped with a base surface 10*a* from which emerges a plurality of mounting studs 100 aligned with each other in a direction of alignment.

The exemplary embodiment considered herein relates to the possible presence of four mounting studs 100, arranged with equal spaces between them and aligned in the direction of the longer sides of the body 10, which has a generally rectangular shape.

In various embodiments, both the number and arrangement of the studs may be different (for example, with the studs not equally spaced and not aligned).

In various embodiments, the shape of the body 10 and the shape of the casing H (FIG. 12), which may be matched to each other if required, may therefore be different from the rectangular shape shown herein by way of example: consequently, square, circular, elliptical, mixed line, or other shapes are possible.

In various embodiments, the boards 12*a*, 12*b* (indicated by different references for reasons given below) may be provided with holes 120 through which the studs 100 are intended to pass when the boards 12*a*, 12*b* are inserted into the body 10, as shown more clearly in FIG. 2.

The boards 12*a*, 12*b* are provided, in a known way, with arrays of contacts, clamps or terminals forming "locations" for the mounting of the light radiation sources 14.

The exemplary embodiments illustrated herein relate to light radiation sources 14 formed by arrays or clusters of LEDs, comprising, for example, eight LEDs arranged in a 4×2 rectangular matrix. Clearly, the nature, number and distribution of the sources in question may be different, according to the specific application requirements.

In various embodiments, the boards 12*a*, 12*b* may include, for each hole 120, two mounting locations 122, 122' which are mutually opposed, that is to say arranged on opposite sides of the hole 120 in question. Thus, when the boards 12*a*, 12*b* are mounted in the body 10 (see FIG. 2), the two locations of each pair 122, 122' lie on opposite sides of the stud 100 which extends through the hole 120.

In various embodiments, the two mounting locations 122, 122', which form a mirror image of each other, may lie on opposite sides of the stud 100 in the direction of alignment of the studs 100. In various embodiments, the direction of opposition may be different, being for example orthogonal to the direction of alignment of the studs 100.

Figure 2:
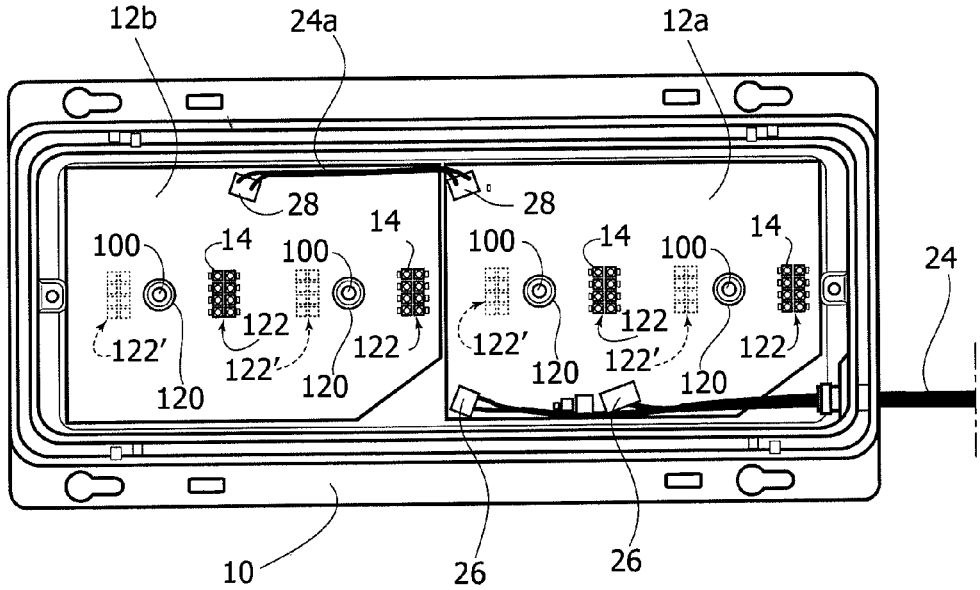
FIG. 2 shows procedures for mounting the components in the component of FIG. 1, FIGS. 3 and 4 show examples of these components.
Figure 3:
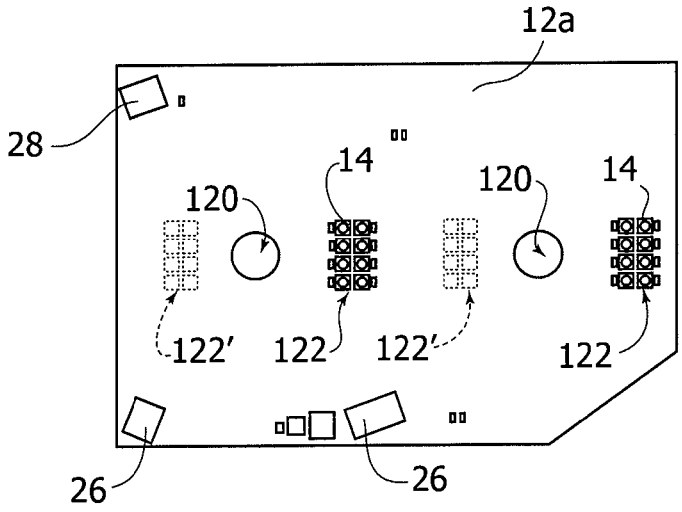
Figure 4:
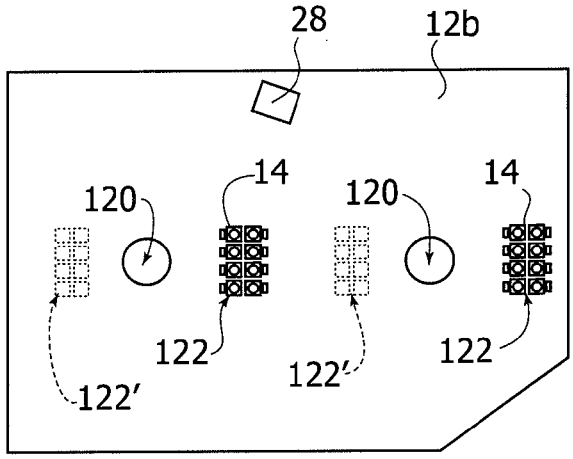

In FIGS. 2 to 4, the mutually opposed mounting locations associated with each hole 120 are shown, respectively, in solid lines (position 122) and in broken lines (position 122') to highlight the fact that only one of these locations (for example, that which is indicated by 122 and shown in solid lines) is actually "populated" with a light radiation source 14 in the example shown.

FIGS. 2 to 4 relate—in a purely exemplary way—to cases of use in which the "populated" locations 122 are those lying on the right of the hole as seen from the point of observation.

The choice of which of the two opposite positions 122, 122' associated with each combination of hole 120 and stud 100 is to be populated with the light radiation sources (in practice, the choice is between the two opposite locations 122, 122' in which a light radiation source 14 can be mounted) may have any outcome and may be made according to the application requirements in line with the criteria described more fully below.

By making the studs 100 penetrate into the holes 120, the boards 12*a*, 12*b* (connectable according to the electrical connection or wiring system described more fully below) can be mounted in the body 10, and the reflectors 16 can be fitted onto the studs 120.

In various embodiments, the reflectors 16 (which can be made, for example, of internally aluminized plastic material) may have shapes such as those shown by way of example in FIGS. 6 to 9.

In various embodiments, the single reflector 16 may be composed of two parts 16*a*, 16*b* that can be joined together.

In various embodiments, the reflectors 16 may have, in addition to a hole 160 which allows the reflector 16 to be fitted onto one of the studs 100, an inlet opening 162 for the light radiation produced by the sources 14 and one or more outlet openings 164. Through the outlet opening or openings, the light radiation produced by the sources 14, which enters the reflector 16 through the opening 162, is projected to the outside of the device.

This may take place, for example, through the casing H, made of transparent material.

In various embodiments, the reflectors 16 may be generally V-shaped (or U-shaped, if this description is preferred, that is to say in the form of an "inverted saddle") with a pair of outlet openings 164.

In various embodiments, the reflectors may then be held in position with the boards 12*a*, 12*b* held between the reflectors 16 and the base wall 10*a* of the body 10 by means of the retaining bar 18.

In various embodiments, the bar 18 may be provided with holes 180 for the passage of fastening screws 182 (self-tapping screws, for example) screwed into the heads of the studs 100 (and if necessary also into other parts, such as further end studs) of the body 10.

In various embodiments, the reflectors 16 may be shaped in such a way that they can be fitted onto the studs 100 in two opposite mounting positions, such that the radiation inlet opening 162 can be located, alternatively, at one or the other of the locations 122, 122' provided for the mounting of the light radiation sources 14 at the position of each opening 120 (and of each stud 100).

For example, this result can be achieved by selecting a distance between the hole 160 and the inlet opening 162 which corresponds to the distance which, in the boards 12*a*, 12*b*, separates the holes 120 and the mounting locations 122, 122' arranged on the opposite sides of each hole.

Thus, each reflector 16 can be mounted in two positions mutually rotated through 180° relative to each other, with a corresponding modification of the orientation of the "lobe" of light radiation projected by each reflector to the outside of the device 10.

Figure 8:
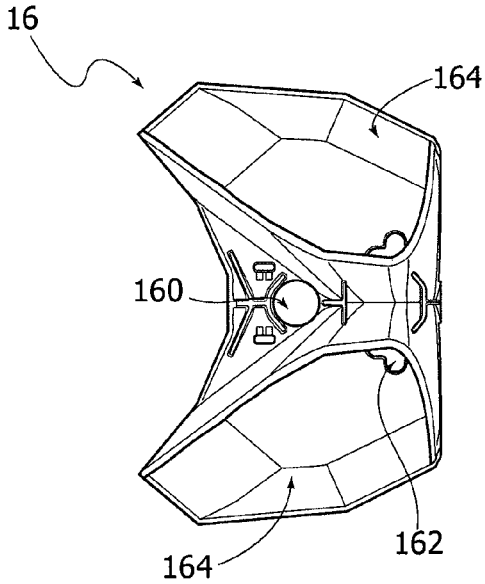
Figure 9:
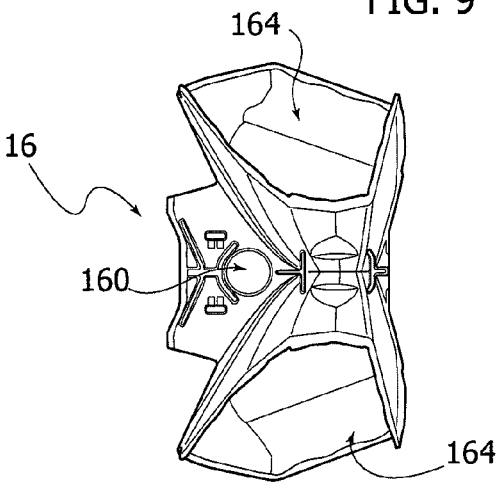
Figure 14:
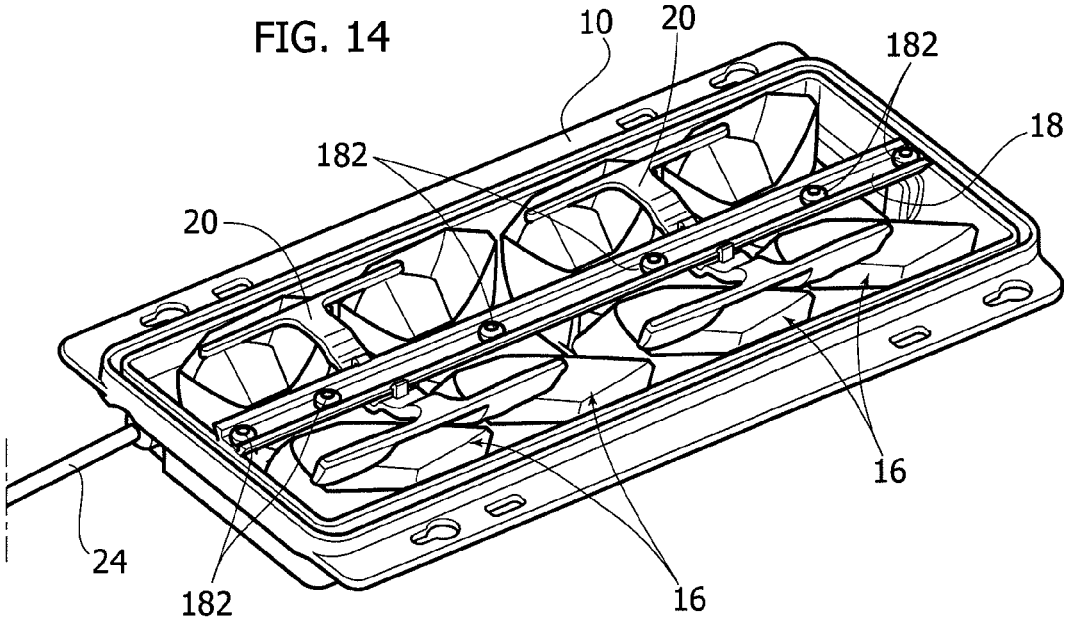
FIGS. 14 to 17 show various developments of embodiments.

FIGS. 8 and 9 show how, while retaining the same relative arrangement between the hole 160 and the inlet opening of the radiation 162 (that is to say, while retaining the possibility of mounting in the two opposite positions described previously) in various embodiments at the position of the studs 100, it is possible to mount reflectors of different types, for example "large" reflectors (such as those shown by way of example in FIG. 8, intended, for example, for highway lighting) or "smaller" reflectors, as shown in FIG. 9 (to be used, for example, for lighting a bicycle path). This can all be achieved while allowing for the combined use of different reflectors, for example large and small reflectors.

Figure 6:
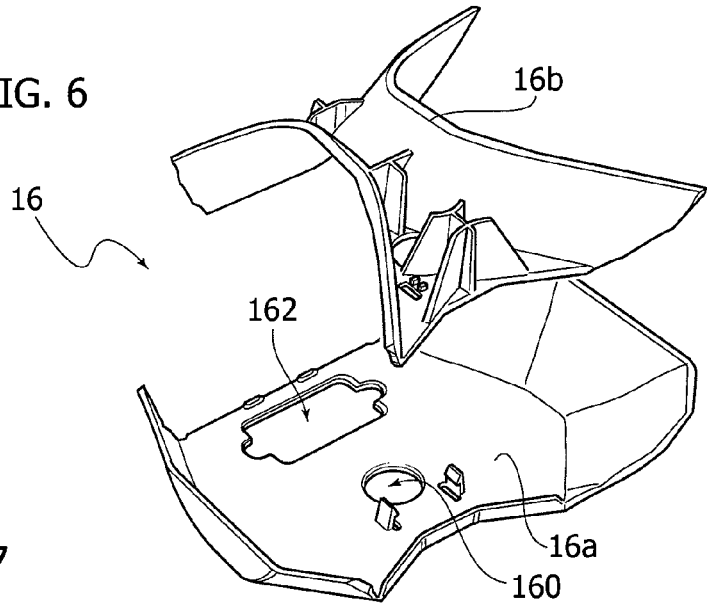
FIGS. 6 to 9 show, from different viewpoints and, in the case of FIG. 6, in an exploded perspective view, various components according to various embodiments.
Figure 7:
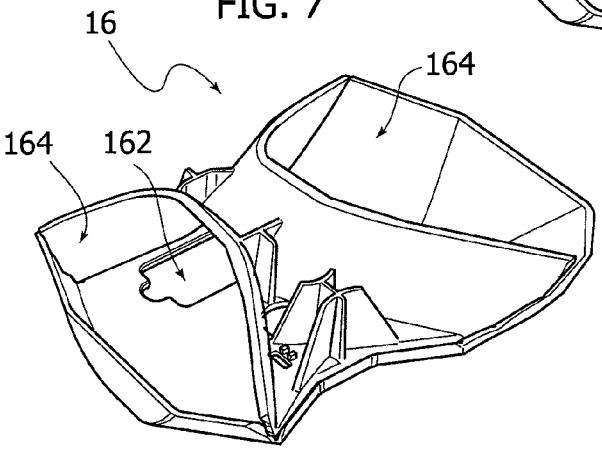

As shown more fully in FIG. 6, the possibility of using reflectors of different sizes and shapes can be combined with the possibility of using a single type of base portion 16*a* to which different upper portions 16*b* can be coupled according to specific requirements.

In various embodiments, the two portions 16*a*, 16*b* can be connected together permanently, or can be kept in the coupled condition by the same methods as those used to keep the reflector 16 as a whole in position, for example by means of the fastening bar 18.

Figure 5:
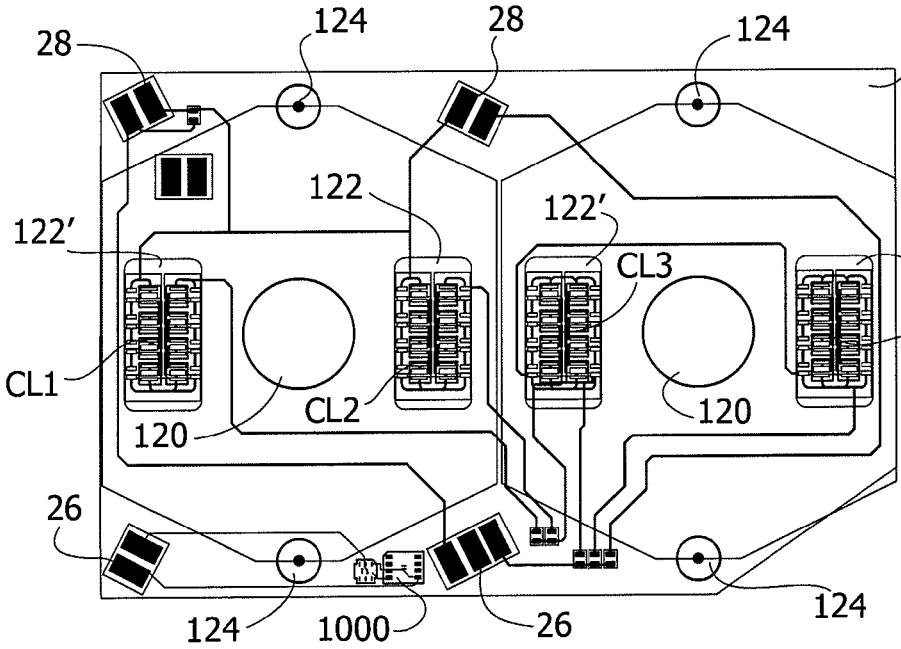
FIG. 5 is an example of a general wiring diagram of some embodiments.

Various embodiments may have a high degree of flexibility of use, due, for example, to the fact that two light radiation sources (for example two clusters of LEDs) can share a single board, for example with the possibility (as shown in FIG. 5) of providing four mounting locations on a single board 12, with the possibility of choosing which two locations are to be activated by populating them, for example, with a cluster of LEDs at each one.

FIG. 5 is a schematic representation of a board 12 which, as described more fully below, can be configured either as a master board 12*a* or as a slave board 12*b*, showing possible wiring configurations.

FIG. 5 shows in a theoretical way the possibility of using the four mounting locations 122 and 122' shown therein (two pairs of opposite locations, one pair for each hole 120) to mount two clusters of LEDs on the board 12, these clusters being chosen from four clusters denoted CL1, CL2, CL3 and CL4, in particular by selecting as the two clusters to be mounted on the board 12:

a first cluster selected from the clusters CL1 and CL2, and a second cluster selected from the clusters CL3 and CL4.

In various embodiments, a lighting device as described herein can be provided without the light sources 14, which can be mounted on the device only at the time of installation.

In various embodiments, a lighting device as described herein can be associated with a set of boards 12 carrying light radiation sources 14 mounted in one or the other of the mounting locations 122, 122' with the possibility of selecting in each set the boards having the sources 14 mounted in the appropriate locations for the specific intended application.

FIG. 5 shows exemplary embodiments in which a single board 12 with four mounting locations can be provided with a single electrical wiring circuit connecting the four locations in question, with the capacity of providing an electrical power supply in all cases to two sources 14 (selected, for example, from the four clusters CL1, CL2, CL3, CL4), regardless of which mounting locations are actually populated.

This can all be achieved while allowing a single base board structure to have either the characteristics of a master board, intended to receive the electrical power supply from outside the device through a power supply cable 24, or the functions of a slave board which receives its power supply from a master board.

In the exemplary embodiment to which FIG. 2 relates, the board shown on the right, indicated by 12*a*, acts as a master board, receiving its power supply from the outside through the electrical conductor 24, while the board shown on the left, indicated by 12*b*, acts as a slave board, receiving its electrical power supply from the master board 12*a* through an electrical conductor 24*a* which is made to connect the two boards 12*a* and 12*b*.

In various embodiments, the mounting solution described herein allows electrical power to be supplied to the device 10 by using a single power supply conductor 24.

FIGS. 3 and 4 illustrate the possibility of using a set of connectors/terminals present in any form on a base board structure (indicated by 12 in FIG. 5) to form, respectively, a master board 12*a* (FIG. 3) and a slave board 12*b* (FIG. 4). In various embodiments, this can be done by providing in the "base" structure 12 a number of wire-to-board connectors 26 (for use in connecting an external conductor 24 to a master board 12*a*) equal to the number of board-to-board connectors 24 for use in transferring the power supply among a plurality of boards.

Although the examples shown in FIGS. 2 to 5 refer to the presence of two boards 12 (configured as a master board 12*a* and a slave board 12*b* if required), with each board carrying a pair of mounting locations 122, 122' arranged in symmetrically opposite positions around a hole 120 (and around the stud 100 which extends through the latter), similar considerations to those set out above apply to a different number of boards and/or to mounting locations in numbers and/or positions other than those mentioned by way of example herein (for example, four locations arranged in the form of a cross around a hole 120).

The diagram in FIG. 5 also shows by way of example the possibility of mounting on the board 12 (which may be a master board 12*a* or a slave board 12*b*) electronic circuits 1000, for example circuits having the function of monitoring the light sources 14 (by temperature monitoring, service life measurement, etc.).

The diagram of FIG. 5 also shows the possible presence of centering holes 124 which enable the boards 12*a*, 12*b* to be mounted precisely in the body 10 (by interaction with studs provided in the centering body 10 if necessary), as well as the possibility of populating the locations 122, 122' with a variable number of light radiation sources (for example by using a number of LEDs other than eight in one or more clusters, according to the example given above). In various embodiments, it is also possible to provide a virtual ("0 ohms") component placed in the proximity of the mounting location which from time to time is not populated.

In this context, it has also been found that the fact that any specific mounting location 122, 122' is not populated has no appreciable effect on the overall distribution of light radiation emitted by the device.

FIGS. 10 to 12 (which, for simplicity, refer to an observation point substantially similar to the point of view of a person observing, from below, the device L mounted on top of a standard P having a top portion inclined toward the horizontal plane) show by way of example the possibility, described above, of mounting the reflectors 16 (chosen from a range of reflectors 16 which are structurally similar but differ from each in their characteristics of size and shape—see, for example, FIGS. 8 and 9) in two positions rotated through 180° with respect to each other. In all of these cases, the radiation sources 14 "populating" the locations 122, 122' face the inlet openings 162 according to the mounting position of each reflector 16.

This arrangement can be provided by making use of the fact that the light radiation inlet opening (162 in FIGS. 6 to 9) can be positioned at one or other of the mounting locations 122 or 122' of the board underlying the reflector 16 in such a way that the light radiation emitted from the source 14 which populates the location (122 or 122' respectively) can be received at the inlet, while the opposite mounting position (122' or 122 respectively) is not populated.

The different orientation of the reflector 16 causes a corresponding change in the orientation of the light radiation "lobe" projected by it from the lighting device.

FIGS. 10 and 11 show by way of example how this possibility can be used to modify the radiation configuration (that is to say, the lighting) emitted by the device L.

FIG. 10 shows all the reflectors 16 shown therein (four in the illustrated example, although the number of reflectors could be different) oriented in a first direction, that is to say with an orientation that can be defined as "0°".

FIG. 11 shows all the reflectors shown therein oriented in an opposite direction, that is to say with an orientation that can be defined as "180°".

Since each of the reflectors 16 allows (at least) two possible mounting positions (at 0° and 180°, respectively), if there are four reflectors 16 then it is possible to have sixteen different mounting configurations, namely:

| |
|---|
| 0°, 0°, 0°, 0° |
| 0°, 0°, 0°, 180° |
| 0°, 0°, 180°, 0° |
| 0°, 0°, 180°, 180° |
| 0°, 180°, 0°, 0° |
| 0°, 180°, 0°, 180° |
| 0°, 180°, 180°, 0° |
| 0°, 180°, 180°, 180° |
| 180°, 0°, 0°, 0° |
| 180°, 0°, 0°, 180° |
| 180°, 0°, 180°, 0° |
| 180°, 0°, 180°, 180° |
| 180°, 180°, 0°, 0° |
| 180°, 180°, 0°, 180° |
| 180°, 180°, 180°, 0° |
| 180°, 180°, 180°, 180° |

More generally, when a number n of reflectors 16 is present, $2^n$ different mounting configurations are available, from which the configuration most suitable for the requirements of use can be selected.

The number of available configurations can be increased further by increasing the number of different mounting positions allowed by the reflectors 16 (for example, four reflectors at 90° to each other), with corresponding modification of the number of opposite mounting locations provided around each hole 120.

In various embodiments, the fact that the reflectors 16 (and the boards 12*a*, 12*b*) are kept in position by the bar 18 fastened by screwing (at 182) to the body 10 facilitates both the operation of mounting the device 10 (in terms of the wiring operations and other aspects) and any dismantling for the purpose of replacing one or more of the reflectors 16 and/or providing a different orientation of the reflectors 16 (with corresponding modification of the arrangement of the "population" of the boards 12*a*, 12*b* with light radiation sources 14).

In various embodiments, the reflectors 16 may have rotational symmetry about the mounting position on the respective studs 100, so that, except as regards the different orientation of the lobe of outgoing radiation, the relative positions of the reflector 16 and of the light radiation source 14 located in the mounting position 122 or 122' and therefore facing the inlet opening 162 remain unchanged regardless of the chosen orientation.

In various embodiments, and as shown more fully in FIG. 13, the bar 18 may have a wedge-like (or V-shaped) profile diverging toward the outside of the lighting device, making it possible to carry out a (self-)centering function in relation to the reflectors 16, particularly if the general shape of the latter takes the form of a V or an inverted saddle as shown by way of example in the drawings.

In various embodiments, it is possible to use auxiliary reflectors 20 together with the "main" reflectors 16, the auxiliary reflectors being adapted, for example, to make a device L, intended to provide a street (or highway) lighting function, capable of providing a function of illuminating pedestrian areas.

Figure 15:
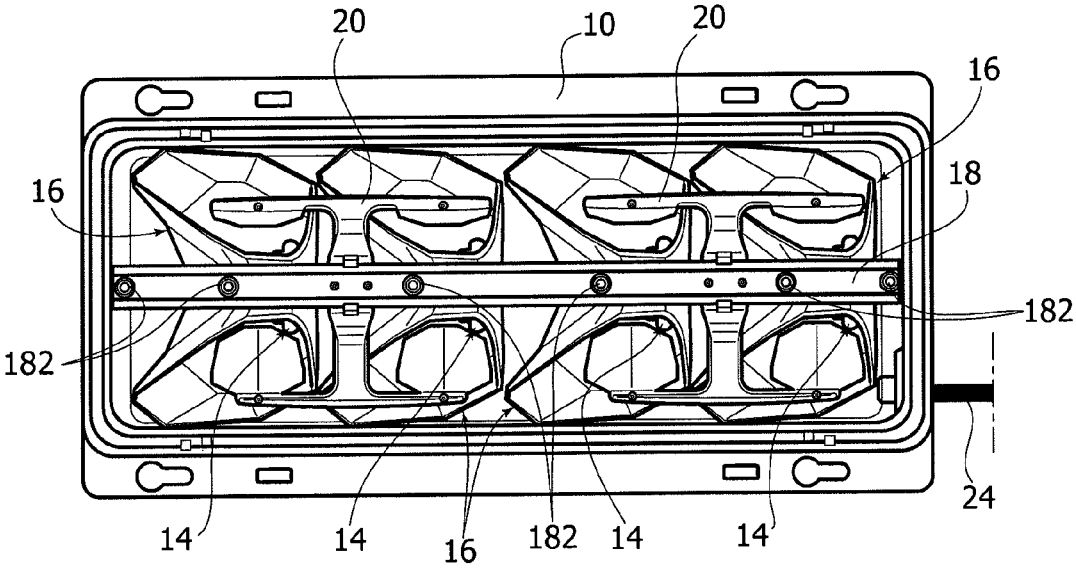
Figure 16:
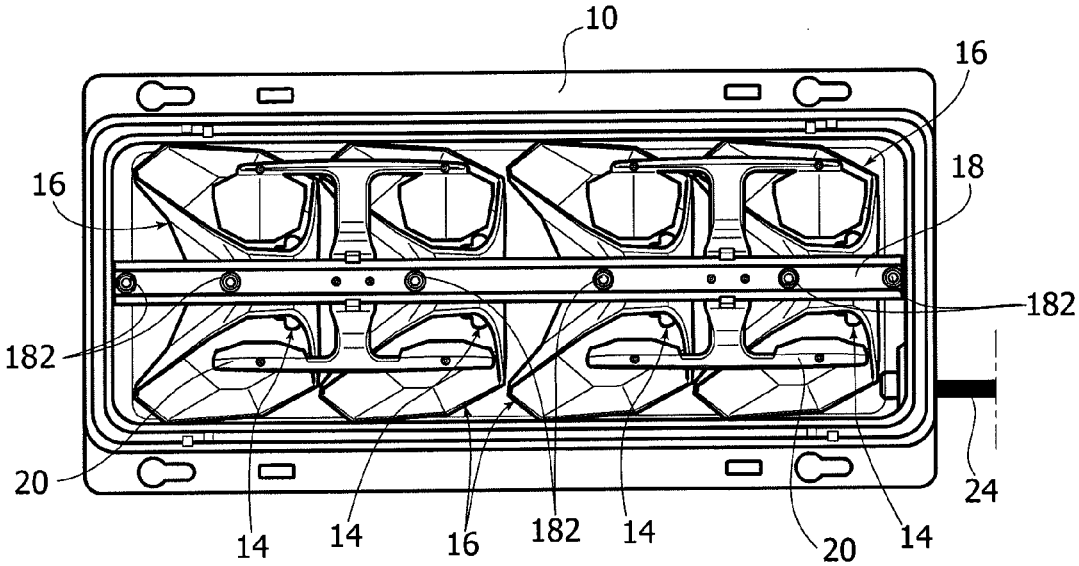

In various embodiments, the auxiliary reflectors 20 may have a general bridge or link shape such that they can be mounted by means of the bar 18 in one of two opposite positions, positioned laterally on one or other side of the body 10 of the device L, as shown schematically in FIGS. 15 and 16.

Figure 17:
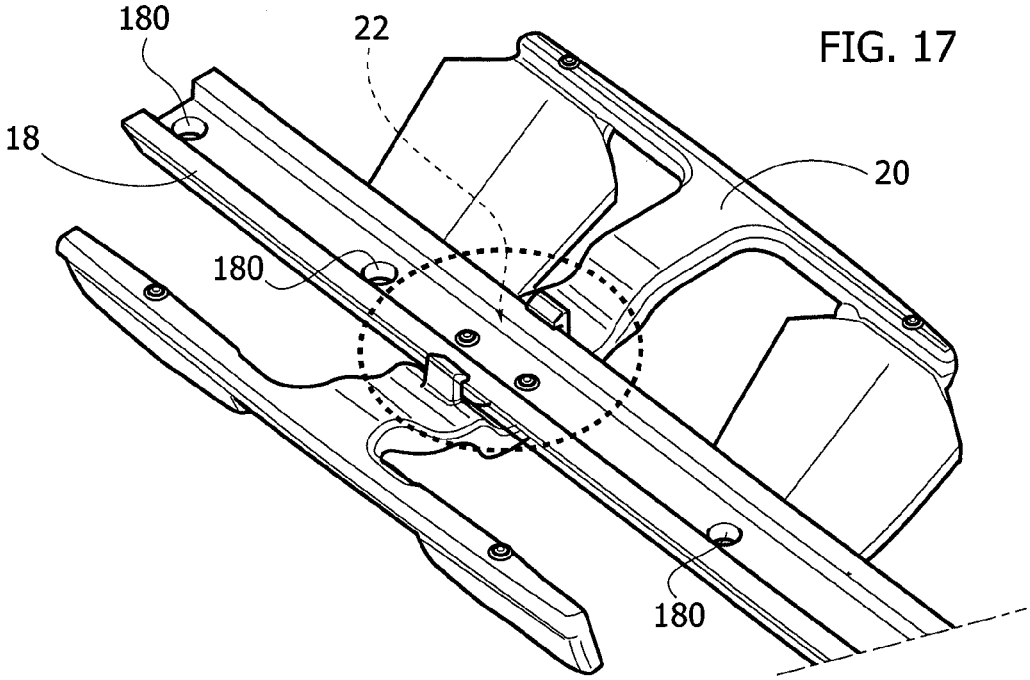

FIG. 17 also shows the possibility of precisely adjusting the positions of the additional reflectors 20 (with respect to the radiation sources 14, for example) by means of holes 22 in the bar 18.

Various embodiments, therefore, enable a high degree of flexibility to be achieved in the assembly of a set of members (the boards 12, populated in advance if necessary, the reflectors 16, the fastening bar 18, and the additional reflectors 20) according to the specific application requirements over a wide range of possible configurations. For example, by using two types of reflectors 16 and additional reflectors (right or left), a total of 1,820 possible different combinations can be provided.

Various embodiments facilitate the management of the logistics of the product.

Various embodiments also simplify the costs of production, both as regards the molding of the various members (which can, for example, be made of plastic material or light metallic material) and as regards the further possibility of providing all the components of the "family" of products with any necessary additional components to be fitted thereto.

Naturally, provided that the principle of the invention remains the same, the details of construction and the forms of embodiment may be varied to a more or less significant extent with respect to those which have been illustrated purely by way of non-limiting example, without thereby departing from the scope of protection, this scope of protection being defined in the attached claims.

The invention claimed is:

1. A lighting device comprising:

a bowl-shaped body having a base surface with a plurality of mounting studs projecting from the base surface;

at least one board for mounting light radiation sources, provided with holes for the passage of respective studs of said plurality, the at least one board having pairs of mounting locations for light radiation sources, each pair being arranged on opposite sides of a respective hole so as to be located on opposite sides of the stud which extends through said respective hole; and a plurality of reflectors for projecting the light radiation from the device, the reflectors having an inlet opening for the light radiation and being capable of being mounted on the aforesaid mounting studs selectively in one of at least two opposite mounting positions in which the inlet opening is placed at one of said mounting locations.

2. The device as claimed in claim 1, comprising a fastening bar that can be coupled to the distal ends of the mounting studs to retain said at least one board holding the light radiation source and said reflectors in the body of the device.

3. The device as claimed in claim 2, wherein the fastening bar has the shape of a wedge diverging away from the base surface of the body of the device.

4. The device as claimed in claim 1, wherein the reflectors are V-shaped with two outlet openings for the light radiation projected from the lighting device.

5. The device as claimed in claim 2, wherein the fastening bar extends between the two outlet openings of the reflectors.

6. The device as claimed in claim 1, comprising a plurality of boards for the mounting of light radiation sources, with a master board having an electrical power input for the device and at least one slave board supplied with electricity from the master board.

7. The device as claimed in claim 1, wherein the reflectors each comprise a base portion and a head portion, the base portion having said inlet opening for the light radiation and the head portion being configured to project the light radiation from the lighting device.

8. The device as claimed in claim 1, comprising additional reflectors for reflecting the light radiation projected from said reflectors.

9. The device as claimed in claim 8, wherein additional reflectors can be coupled to the device in at least two opposite positions for reflecting the light radiation projected from said reflectors in different directions according to the mounting position.

10. The device as claimed in claim 2, comprising additional reflectors for reflecting the light radiation projected from said reflectors, wherein the additional reflectors are coupled to the device with said fastening bar.

11. The device as claimed in claim 10, wherein the additional reflectors are coupled to the device in an adjustable manner.

* * * * *